US006955146B2

(12) United States Patent
Werler

(10) Patent No.: US 6,955,146 B2
(45) Date of Patent: Oct. 18, 2005

(54) SYSTEM FOR VARIABLY ACTUATING VALVES IN INTERNAL COMBUSTION ENGINES

(75) Inventor: Andreas Werler, Zwickau (DE)

(73) Assignee: IAV GmbH Ingenieurgesellschaft Auto und Verkehr, Berlin (DE)

( * ) Notice: Subject to any disclaimer, the term of this patent is extended or adjusted under 35 U.S.C. 154(b) by 117 days.

(21) Appl. No.: 10/370,290

(22) Filed: Feb. 19, 2003

(65) Prior Publication Data

US 2003/0226530 A1 Dec. 11, 2003

(30) Foreign Application Priority Data

Dec. 11, 2000 (DE) ..... 100 61 618
Jun. 10, 2002 (DE) ..... 102 26 300
Dec. 20, 2002 (DE) ..... 202 20 138 U

(51) Int. Cl.[7] ..... F01L 1/34

(52) U.S. Cl. ..... 123/90.16; 123/90.15; 123/90.2; 123/90.41; 123/198 F; 74/519

(58) Field of Search ..... 123/90.15, 90.16, 123/90.2, 90.27, 90.31, 90.39, 90.41, 90.44, 90.45, 198 F; 74/519; 251/95–110, 231, 233–238

(56) References Cited

U.S. PATENT DOCUMENTS 2,934,052 A * 4/1960 Longenecker ..... 123/90.16
4,572,118 A 2/1986 Baguéna
4,723,515 A * 2/1988 Burandt ..... 123/90.16
4,898,130 A * 2/1990 Parsons ..... 123/90.16
5,205,247 A * 4/1993 Hoffman ..... 123/90.16
6,354,255 B1 * 3/2002 Methley et al. ..... 123/90.16

FOREIGN PATENT DOCUMENTS

| | | |
|---|---|---|
| DE | 26 29 554 | 1/1978 |
| DE | 38 33 540 | 4/1990 |
| DE | 199 13 742 | 9/2000 |
| DE | 101 23 186 | 11/2002 |

* cited by examiner

*Primary Examiner*—Thomas Denion
*Assistant Examiner*—Kyle M. Riddle
(74) *Attorney, Agent, or Firm*—Collard & Roe, P.C.

(57) ABSTRACT

A system for variably actuating valves by means of cams for internal combustion engines has the following type of construction: A camshaft is rotationally supported in the cylinder head and has a fixed position in relation to the valves and their associated stroke-transmitting arrangements. A stroke-transmitting arrangement guided in a fixed position is associated with each of the valves arranged in the cylinder head and closes by means of spring force. A variable position element for adjusting the stroke of the valve is guided in a stationary manner in the cylinder head. An intermediate element is supported and pivotably guided on the variable position element. A cam of the camshaft is engaged by the intermediate element and is supported in a stationary manner in the cylinder head, as well as the stroke-transmitting arrangement associated with the valve.

22 Claims, 11 Drawing Sheets

4
5
11
F
3
2

SYSTEM FOR VARIABLY ACTUATING VALVES IN INTERNAL COMBUSTION ENGINES

BACKGROUND OF THE INVENTION

1. Field of the Invention

The invention relates to a system for variably actuating valves by means of cams for internal combustion engines.

2. The Prior Art

Systems for variably actuating valves by means of cam disks are known from German Patent No. DE 38 33 540 A1. In such systems, a camshaft is supported in the cylinder head in a rotational manner and is supported in a fixed position relative to the valves to be actuated and their associated arrangements for transmitting the stroke. An arrangement for transmitting the stroke is guided in a fixed position and associated with each of the valves arranged in the cylinder head. The valves are closed via spring force. Such an arrangement for transmitting the stroke may be a swivelling or rocker lever arrangement, or a bucket tappet as shown in FIGS. 1 and 2 of this patent. In these known systems, an element for automatically compensating the play of the valve may be arranged between the driven element and the valve shaft. An element intended for adjusting the stroke of the valve is arranged and guided in the cylinder head. The position of this element can be varied. An intermediate element is supported on the above-mentioned, variable element. The position of this intermediate element can be varied and can be displaced on the variable element. Furthermore, this intermediate element engages a cam of the camshaft that is supported in the cylinder head in a fixed position, and also engages the arrangement for transmitting the stroke that is associated with the valve.

The intermediate element can be articulated on the pivot lever of the arrangement transmitting the stroke, or it may be guided in a straight line and driven by thrust, or it may be guided on the head of a bucket tappet in a circular track. (See FIGS. 1–3 of DE 38 33 540 A1). However, these systems have disadvantages in the way in which the intermediate element is guided or controlled via sliding surfaces, and the relatively non-compact design of the arrangements.

A device for adjusting the stroke of a gas-changing valve in the cylinder head of an internal combustion engine is known from German Patent No. DE 199 13 742 A1. In this device, a swivel lever is provided with a no-load cam on one end and a control track comprising a stroking cam, whereby these cams are engaged during the stroking movement by line contact with a transmission element driving a gas-changing valve. The swivel lever engages a cam in about the center via a roller that is acted upon by a resetting spring. During its pivoting movements effected by the cam and the resetting spring, this swivel lever is guided by means of a control lever that is rotationally supported coaxially in relation to the axis of rotation of a control shaft, on the one hand, and guided at its second end by line contact on a cam disk, on the other hand. This cam disk is mounted on a control shaft that extends in the cylinder head parallel with the camshaft and supported in a rotational or fixed manner. The control shaft determines by means of its position the starting position of the swivel lever and thus whether only the no-load cam, or to which extent the stroking cam of the control track on the swivel lever will become active during the stroke of the cam on the transmission element driving the gas-changing valve. This has disadvantages in that the swivel lever pivots about an approximately vertical axis in relation to the transmission element, and is guided by a stationary control lever. This requires a considerable amount of space above the valves in the cylinder head as well as mechanical expenditure.

SUMMARY OF THE INVENTION

It is therefore an object of the invention to provide a system for variably actuating valves of the type specified above that is compact and can be realized in a favorable manner in terms of kinematics, and has low stresses acting on the components of the mechanical system.

This object is accomplished by a system for variably actuating valves by means of cams for internal combustion engines with the following type of construction:

1. A camshaft is rotationally supported in the cylinder head and has a fixed position in relation to the valves and their associated stroke-transmitting arrangements;
2. a stroke-transmitting arrangement guided in a fixed position is associated with each of the valves, which are arranged in the cylinder head and close by means of spring force;
3. a variable position element for adjusting the stroke of the valve is guided in a stationary manner in the cylinder head;
4. an intermediate element is supported and pivotably guided on the variable position element; and
5. a cam of the camshaft is engaged by the intermediate element and is supported in a stationary manner in the cylinder head, as well as the stroke-transmitting arrangement associated with the valve.

The variable position element is adapted to pivot around an axis of swivel positioned fixed in the cylinder head and comprises a support cam and a control cam arranged one after the other. The intermediate element is supported in a force-locked manner on the outer contour of the support cam and the control cam by a U-shaped inner contour opening.

The prismatic-type of guidance of the intermediate element as defined by the invention, via its U-shaped inner contour on the variable position element, and is pivot-mounted, pivoting about an axle of swivel positioned in the cylinder head in a fixed manner, results in a compact arrangement of the system. The variable position element comprises a support cam and a control cam extending next to each other in an area of more than 180°. During the stroking movement, the intermediate element is supported on the outer contours of the support cam and the control cam, in sliding contact or via one or two rollers.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
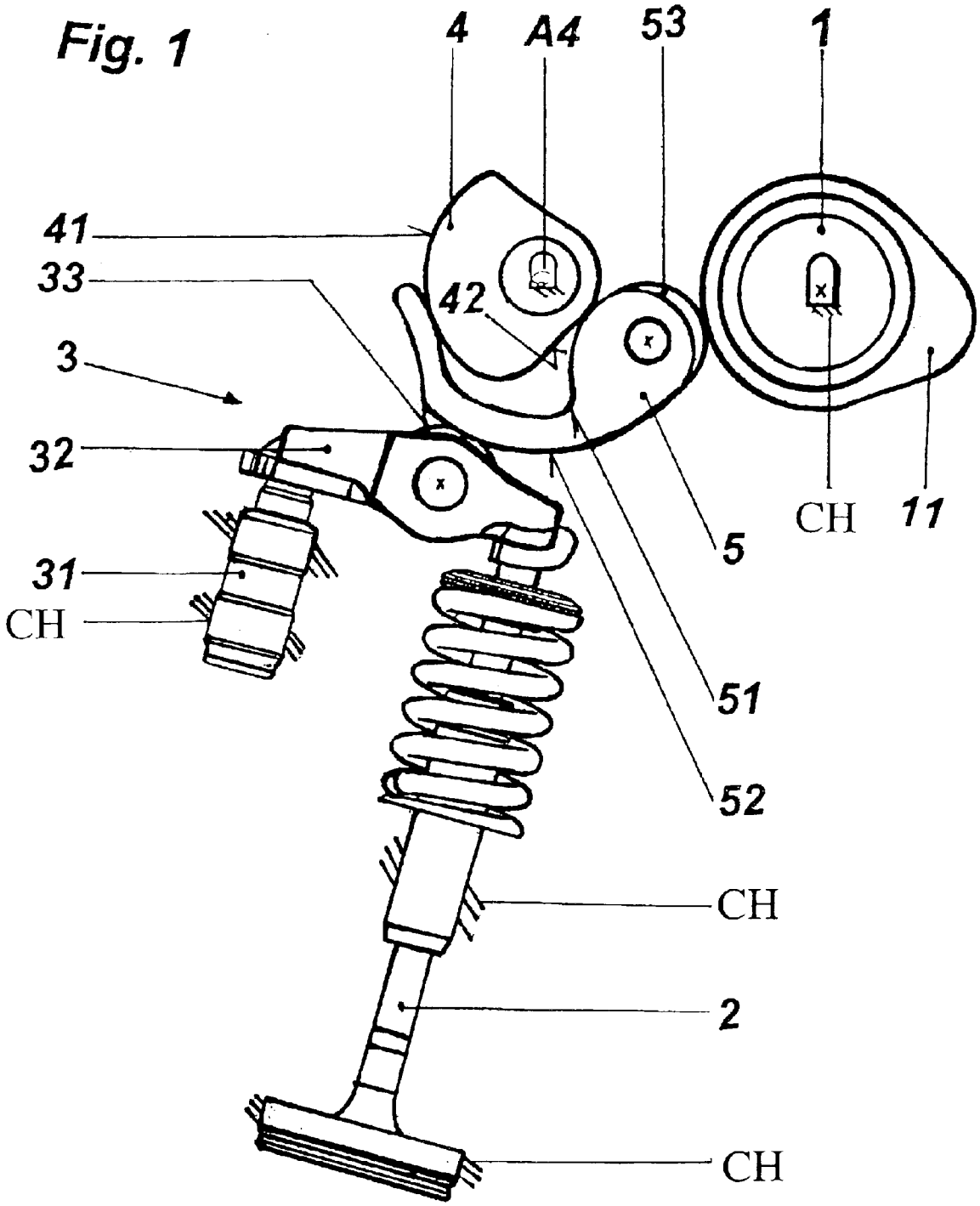
FIG. 1 shows a schematic representation of a valve drive as defined by the invention, with a rocker in the arrangement for transmitting the stroke.

Referring now in detail to the drawings, FIG. 1 shows a system for variably actuating valves by means of cams, which is preferably intended for internal combustion engines. A camshaft 1 driven by the crankshaft optionally via a device setting the angle is supported in the cylinder head CH in a rotational manner, with the axle in a fixed position. This camshaft is in a fixed position in relation to valves 2 and the arrangement 3 for transmitting the stroke that is associated with valves 2. Such a stroke-transmitting arrangement 3, which is guided in a fixed position, is associated with each of valves 2 arranged in cylinder head CH. These valves close by means of spring force. Arrangement 3 for transmitting the stroke is preferably provided with an element 31 for compensating the play.

Element 31 introduces a force and thus a torque via the stroke-transmitting arrangement 3 into intermediate element 5, which assures that intermediate element 5 is retained against variable element 4. Element 4, the position of which can be varied for adjusting the stroke of the valve, is arranged in the cylinder head CH in a stationary manner. However, it is pivot-mounted and pivots around the axis of swivel A4 that is positioned in a fixed manner.

Intermediate element 5 is supported on the inside on element 4, the position of which can be varied, and is guided by element 4 when it is pivoting. Intermediate element 5 engages a cam 11 of camshaft 1 that is supported in cylinder head CH. Furthermore, via its outer contour 52, intermediate element 5 engages stroke-transmitting arrangement 3 that is associated with valve 2, in the present case via a roller lever 32 with a roller 33.

Element 4, the position of which can be varied, has a support cam 41 and a control cam 42, whereby both cams extend in an area covering more than 180°. During the stroking movement, intermediate element 5 is supported on these cams 41, 42 with its U-shaped inner contour 51 in a sliding and force-locked manner. This results in a type of prismatic support for different positions of intermediate element 5. Control cam 42 is arranged on variable element 4 on the side facing cam 11, and support cam 41 is arranged on the side facing away from cam 11.

Intermediate element 5 is subjected to the action of a spring force F. The direction in which this spring force acts keeps intermediate element 5 engaged with cam 11 and variable element 4. This spring force is shown by way of example in FIG. 3.

In a kinematically advantageous manner, the outer contour of support cam 41 of element 4, the position of which can be varied, may be formed around the axis of swivel A4 by a circular arc.

The functions and movements of the mechanical systems as defined by the invention are described in the following.

Figures 2, 3, 4:
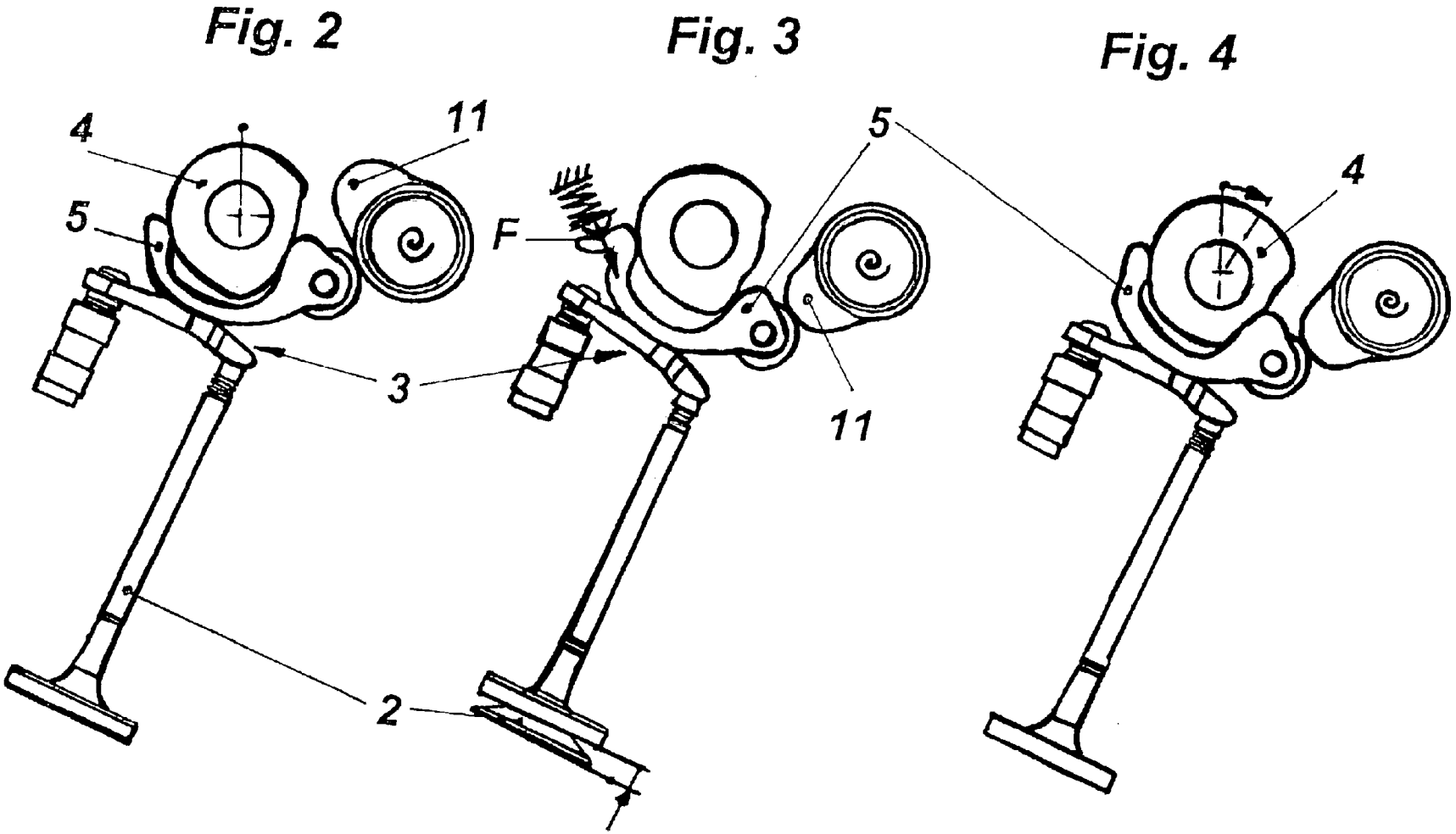
FIG. 2 shows the valve drive according to FIG. 1 in the basic adjustment, with the valve closed.
FIG. 3 shows the basic adjustment with the valve fully opened (=the maximal stroke)
FIG. 4 shows the valve drive in the position of adjustment for the permanently closed valve.

FIG. 2 shows a valve drive according to FIG. 1 by a simplified representation in the basic adjustment with the valve closed. Roller 53 still rolls on the basic circle of cam 11. With further rotation from this position in the counterclockwise direction, roller 53 is continually (or steadily) displaced from the elevation of cam 11 in the direction in which the valve is opened, until it has reached the outermost contour of the cam. In the process of this movement, intermediate element 5 slides with line contact on support cam 41 and control cam 42, and in the direction of the longitudinal expanse via roller lever 32 or its roller 33. The position shown in FIG. 3 is now adjusted in the mechanism, with the valve fully opened in that position. This position represents the maximal stroke. Due to the design and selectable setting (or adjustment) of the angle of control cam 42, it is possible to achieve the desired, variable opening of the valve.

The adjustment for a valve that is permanently closed is shown in FIG. 4. Variable position element 4 with support cam 41 and control cam 42 has been changed vis-à-vis FIG. 3 with respect to its rotational position, with the result that another sliding area of control cam 42 is swept for the line contact of the intermediate element 5 as the movement initiated by the cam 11 is taking place.

As cam 11 rotates in the counterclockwise direction, roller 53 and thus intermediate element 5 with it, are continually (or steadily) displaced from the elevation of cam 11 in the direction in which the valve is opened, until it has reached the outermost contour of the cam. However, the recessed-contour of control cam 42 permits intermediate element 5 to slide over roller lever 32 only in the direction of the longitudinal expanse without forcing the roller lever to be driven in the direction of the valve 2. Intermediate element 5 pivots with a constant radial contour based on the axis of rotation A4 of variable position element 4, swinging between the latter and the roller lever 32. In the present embodiment, intermediate element 5 is unfavorably subjected to bending stress.

Figure 5:
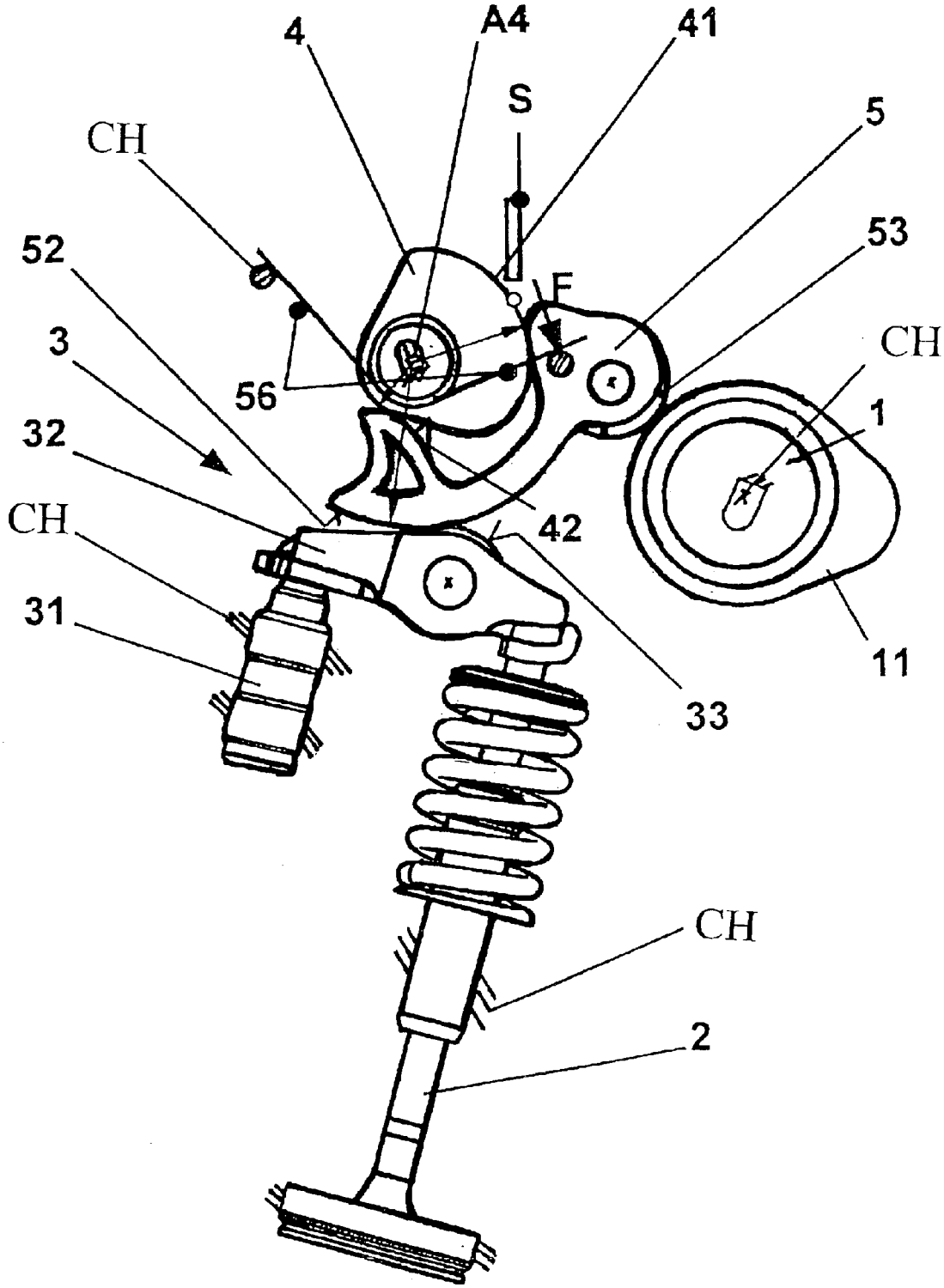
FIG. 5 shows a valve drive as defined by the invention with changed engagement conditions on the variable element and with an intermediate element engaging the variable element in a sliding manner.
Figure 6:
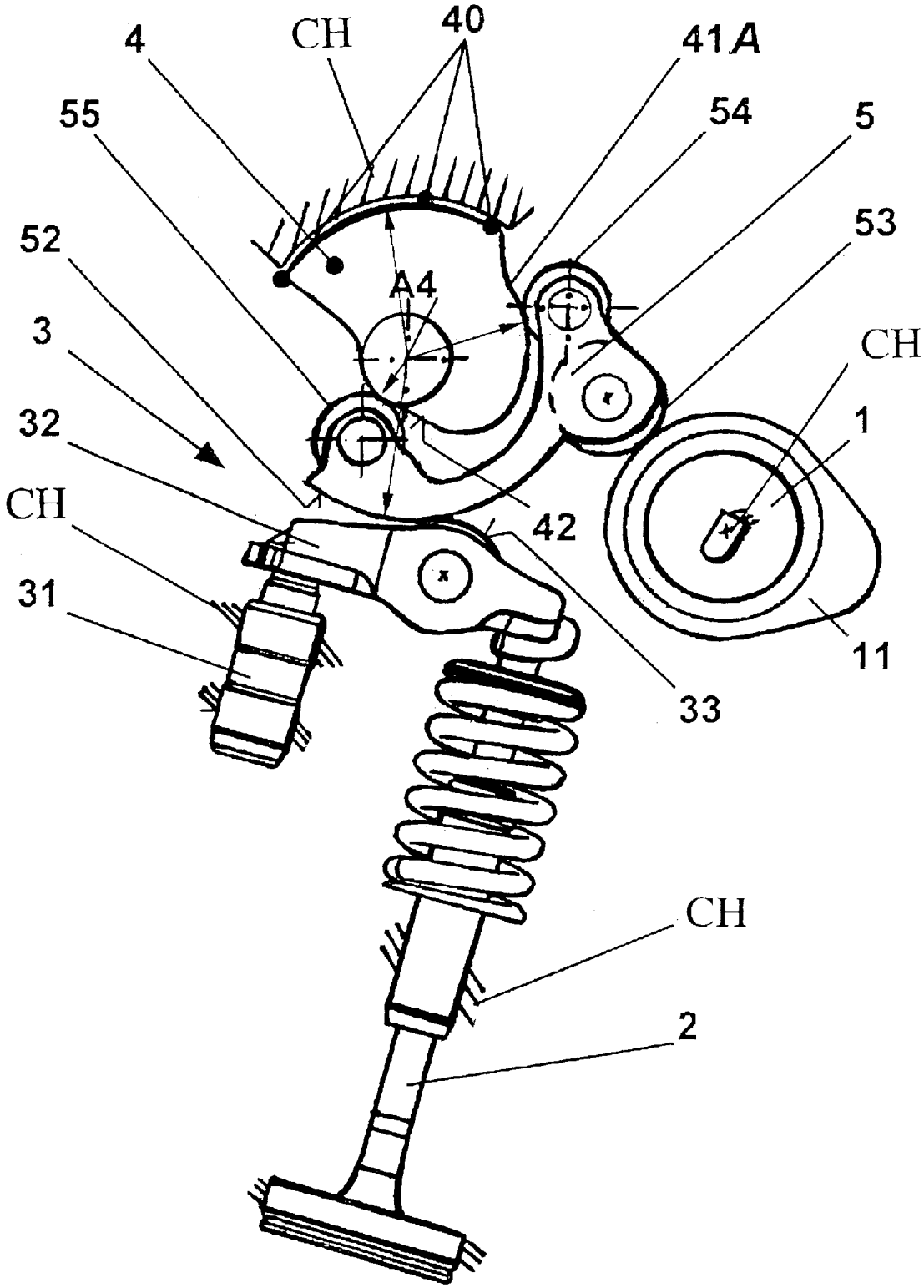
FIG. 6 shows a valve drive as defined by the invention with the embodiment described above; however, with an intermediate element engaging the variable element in a rolling manner, and with an element for directly supporting the variable element.

In connection with the embodiment of the mechanical systems according to FIGS. 5 and 6, control cam 42 on variable element 4 is arranged on the side facing arrangement 3 transmitting the stroke, extending parallel with the latter in a position for zero or minor stroke, or in a slightly slanted manner. The contour effective during the highest stroke follows subsequently.

To obtain favorable mechanical stress on intermediate element 5, the engagement of intermediate element 5 on the cam 11 takes place in such a manner that intermediate element 5, in the course of the opening stroke, is pulled through the opposing areas of engagement on control cam 42 and on stroke-transmitting arrangement 3. In this connection, in the area of movement of high valve-actuating forces, the lines of engagement between control cam 42 and intermediate element 5, as well as between stroke-transmitting arrangement 3 and intermediate element 5, should advantageously extend in an area that extends around the straight line of connection between the axis of rotation of variable element 4, and the line of engagement between stroke-transmitting arrangement 3 and intermediate element 5. This condition is satisfied by the embodiment shown.

Intermediate element 5 is additionally subjected to the action of a spring force F. The direction in which this spring acts retains intermediate element 5 in engagement with cam 11 and with variable element 4. This is shown by way of example in FIG. 5. A component of the force of a spring 56, which is in the form of a wound flexible spring, engages intermediate element 5. This spring is preferably arranged in such a way that it extends around the axis of swivel A4, and it is directly or indirectly supported on cylinder head CH.

FIG. 6 shows an embodiment according to FIG. 5, in which a rotationally supported roller 54, 55 is additionally arranged on intermediate element 5 for the respective engagement on the control cam 42 and, respectively, on the support cam 41. With such an embodiment, and with a roller 33 on the stroke-transmitting arrangement 3 that is engaged with the intermediate element 5, it is possible to achieve an optimal reduction of friction losses.

The use of a roller 54 on intermediate element 5 has the disadvantage that this may increase the mass to be moved, and it may limit the size of the radius that can be realized for the curvature of the surface of engagement on intermediate element 5. Because of the relatively lower forces vis-a-vis the other areas of engagement, intermediate element 5 and support cam 41 may also be engaged with each other in a sliding manner (see FIG. 5). In such a case, a lubricating device S should be associated with such an area of engagement. Such an embodiment is relatively simple in terms of construction and limits the masses that have to be moved in the system of kinematics.

The outer contour of support cam 41 of element 4, the position of which can be varied, is formed by a circular arc around the axis of rotation A4 in an area that is engaged on cam 11 while traveling through the basic circle. As a supplementary measure, the circular arc may change into an ascending contour 41A in the range of the stroke. This ascending contour 41A and control cam 42 jointly influence the movement of intermediate element 5 for producing the stroke (see FIG. 6).

In the embodiment according to FIG. 6, variable element 4 is advantageously supported directly in cylinder head CH with a circular segment 40. This circular segment 40 is arranged on control cam 42 opposite the area of engagement of intermediate element 5. The forces of pressure exerted on element 4 in the course of the stroke are directly supported on the cylinder head CH in the plane in which such forces are acting.

Figure 7:
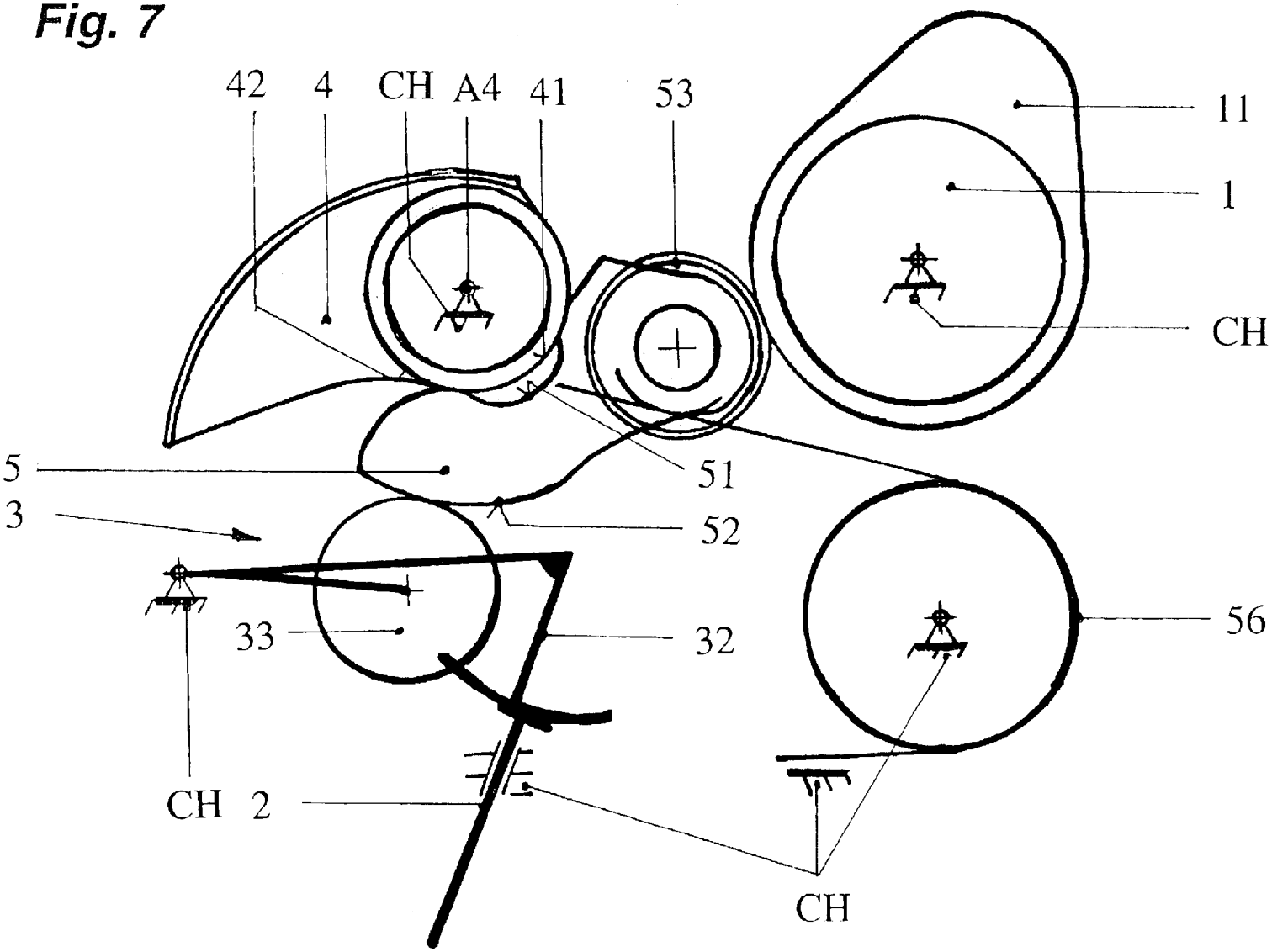
FIG. 7 is a schematic representation of the valve drive as defined by the invention, with a rocker in the arrangement for transmitting the stroke.
Figure 8:
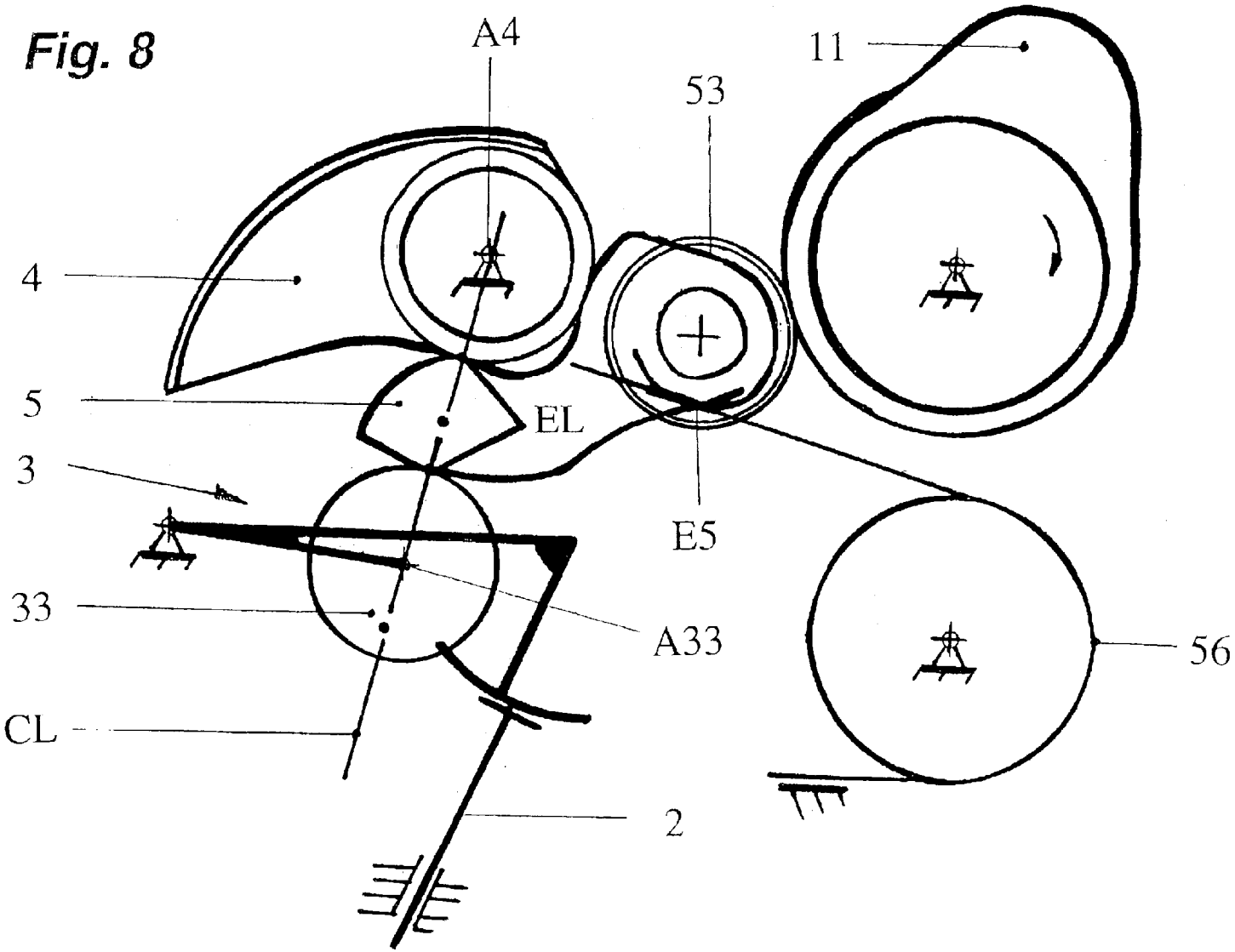
FIG. 8 shows a valve drive according to FIG. 7.

FIGS. 7 and 8 show another embodiment of a valve drive as defined by the invention, with the valve shown in its closed-position. The respective planes of engagement on intermediate element 5 between control cam 42 and stroke-transmitting arrangement 3 extend approximately parallel with one another, whereby the engagement lines EL are disposed on the connection line CL between the axis of rotation A4 and the axis A33 of a roller on the roller lever 32. The forces exerted by intermediate element 5 on stroke-transmitting arrangement 3 substantially act in intermediate element 5 in the form of pressure forces. In this embodiment as well, support cam 41 is arranged on the half of the variable element 4 that is facing the cam 11.

An advantageous embodiment in terms of construction is obtained with an arrangement (not shown) in which the support of stroke-transmitting arrangement 3 on the cylinder head CH is arranged in an area below camshaft 1.

Intermediate element 5 is engaged by a spring 56 in such a manner that the force of this spring keeps intermediate element 5 engaged with cam 11 and the element 4 that is variable with respect to its position. Spring 56 may be a wound flexible spring that is guided on intermediate element 5 in the area of roller 53 in a sliding manner, and supported on the cylinder head CH in a stationary way.

FIG. 8 shows the valve drive with valve 2 closed. Roller 53 rolls on the basic circle of cam 11. With further rotation from this aforementioned position counterclockwise, roller 53 is continually displaced from the elevation of cam 11 in the direction in which the valve is opened, until it has reached the outermost contour of the cam (see FIG. 9). In the course of this process of motion, intermediate element 5 slides with line contact on support cam 41 and control cam 42 in the direction of the longitudinal expanse via roller 33 of arrangement 3 that transmits the stroke. This adjusts in the mechanism the position shown in FIG. 9, with the valve fully opened (=the maximal stroke).

Figure 12:
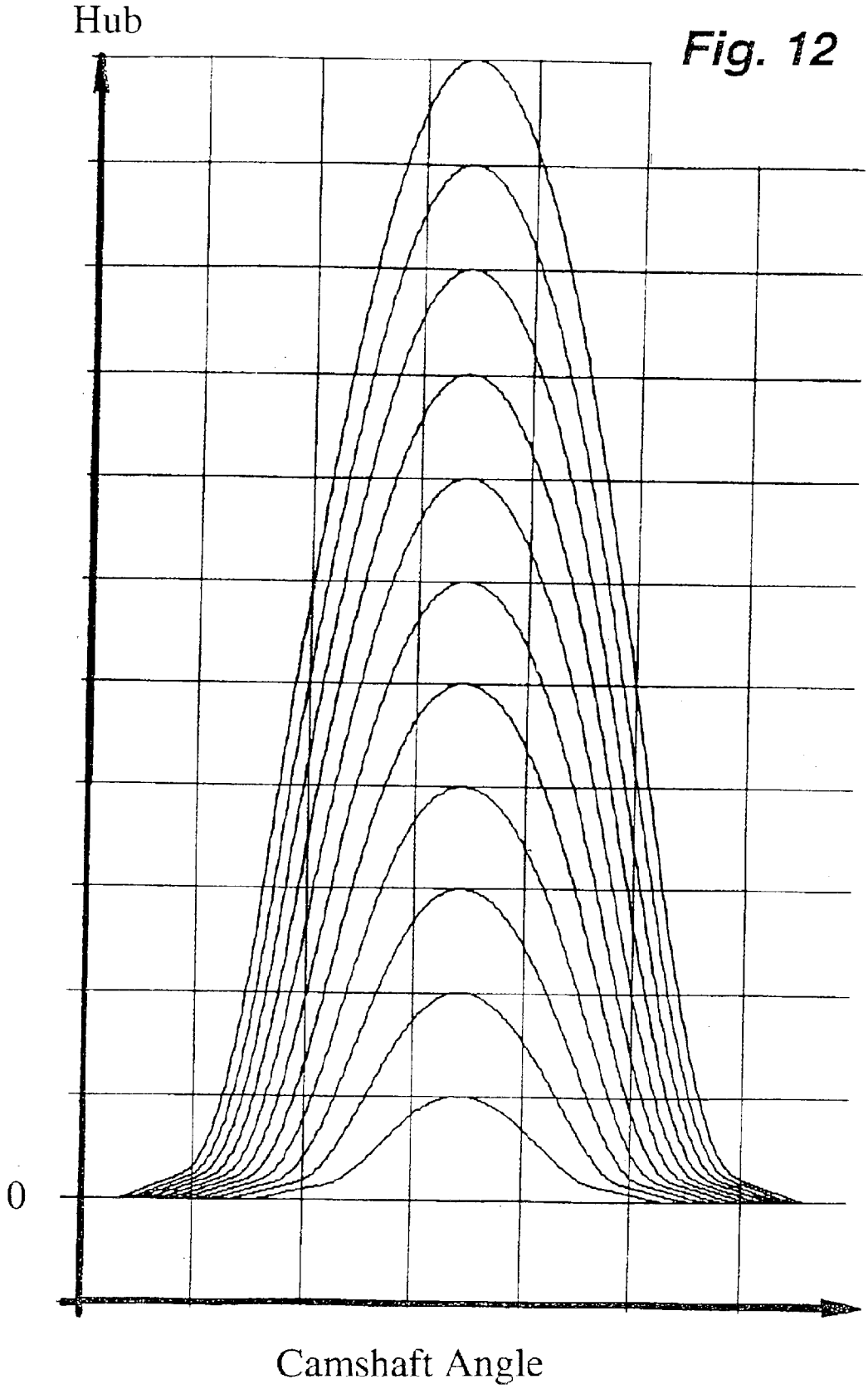
FIG. 12 shows sets of curves with possible valve stroke adjustments of the valve drive as defined by the invention.

In the same manner, by virtue of the design and the adjusted angular position of element 4, it is possible to achieve any desired, variable opening of the valve, which is also feasible in connection with the other embodiments (see also FIG. 12).

Figure 9:
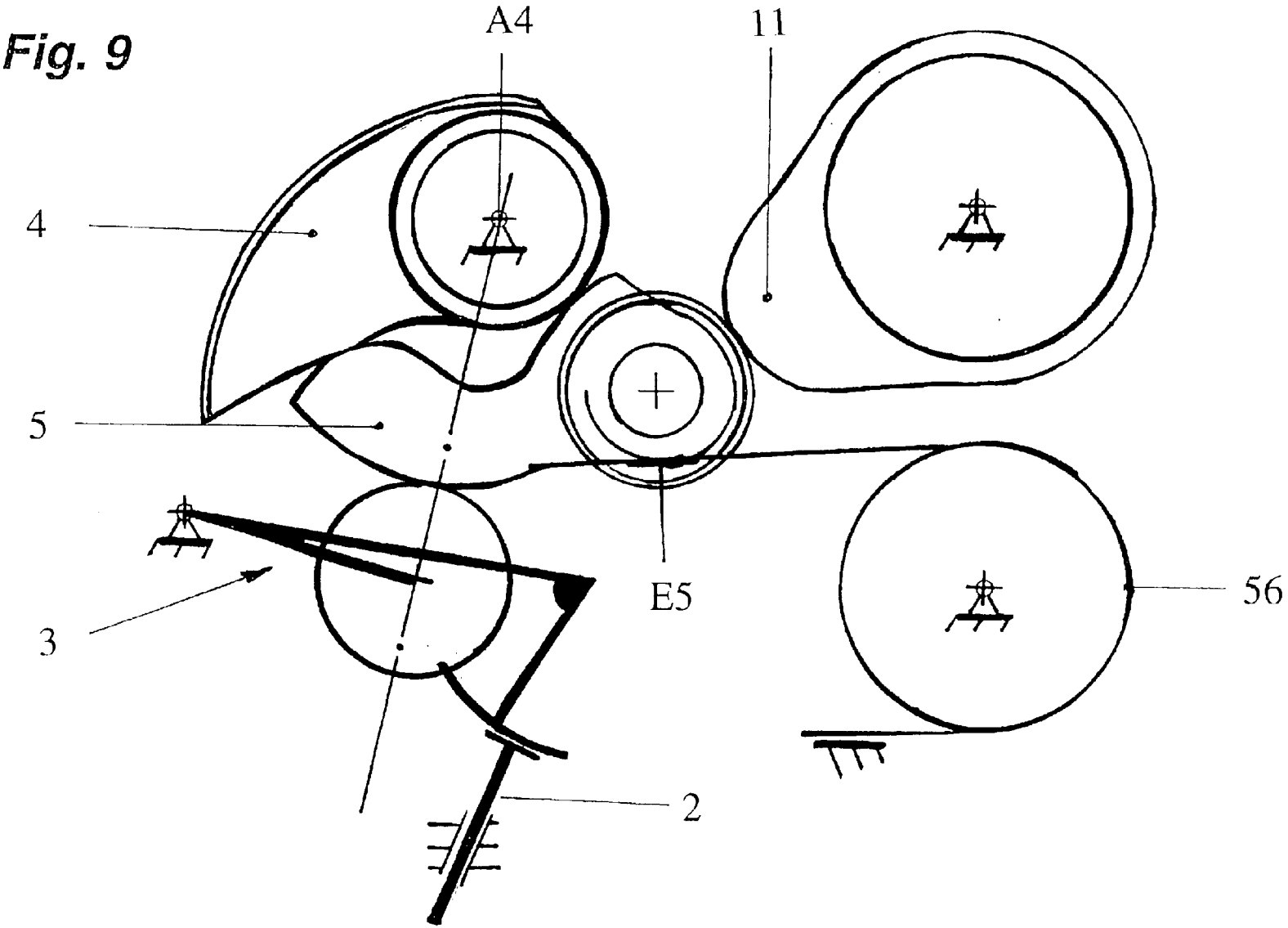
FIG. 9 shows a valve drive according to FIG. 7 with the valve fully opened (=maximal valve stroke) at maximum stroke of the cam.
Figure 10:
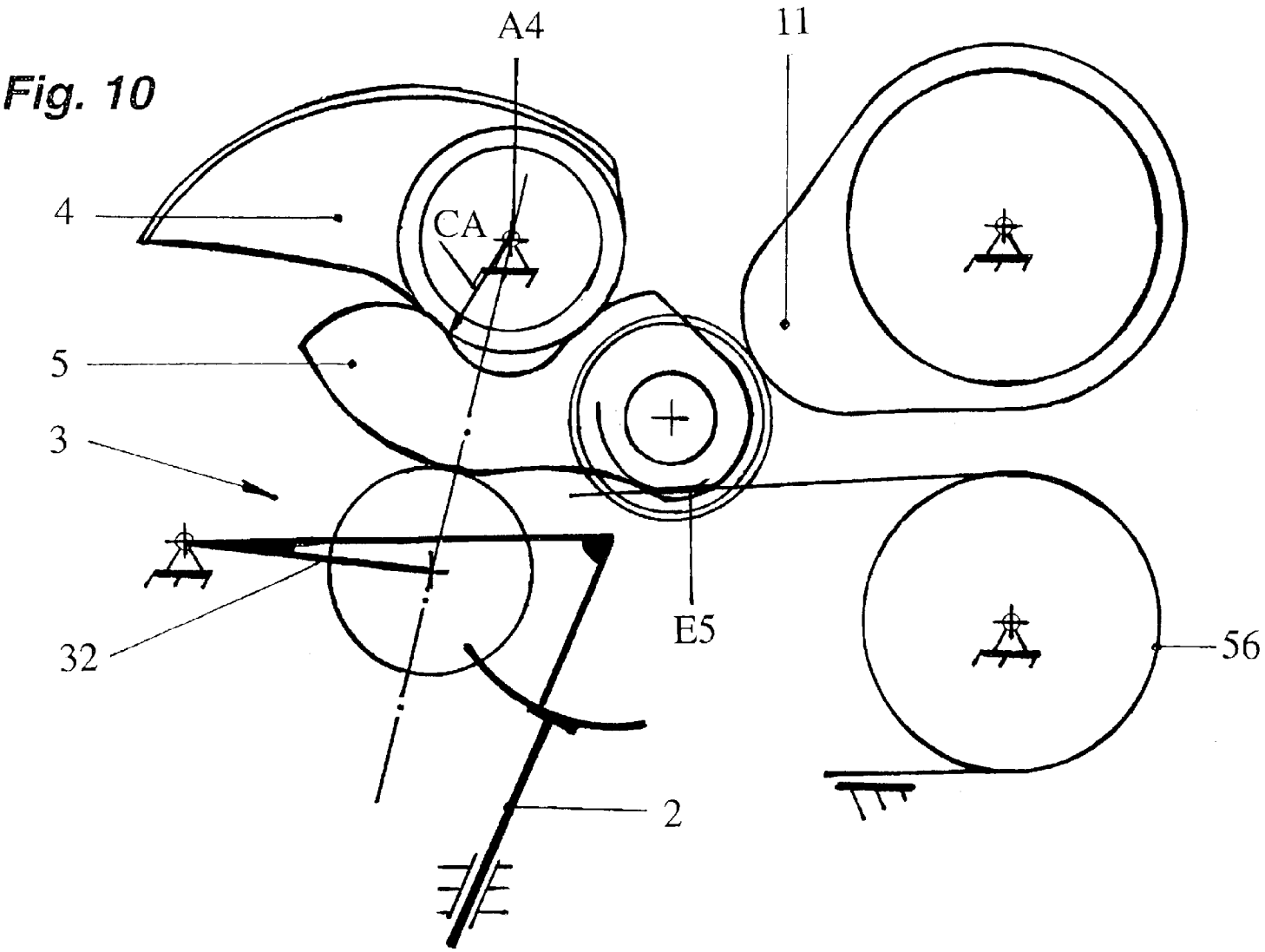
FIG. 10 shows a valve drive according to FIG. 7 in the zero-stroke adjustment position for the valve at maximum stroke of the cam.

FIG. 10 shows the adjustment for a valve that is permanently closed, i.e. with zero stroke. Vis-à-vis FIGS. 7 to 9, the position of variable element 4 with support cam 41 and control cam 42 is changed, with the result that another area is now swept on control cam 41 for the line contact of intermediate element 5 in the course of the movement initiated by cam 11. As it rotates counterclockwise from the area of the basic circle, roller 53 and intermediate element 5 with it, are continually displaced from the elevation of cam 11 in the direction in which the valve opens, until it has reached the outermost contour of the cam. The recessed contour of control cam 42 that is now acting has the effect that intermediate element 5 slides via the roller lever 32 only in the direction of longitudinal expanse without forcing the lever to move in the direction of valve 2. Intermediate element 5 pivots on a contour of the circular arc CA that extends around the axis of swivel A4 of variable element 4, between the contour of circular arc CA and tilt or roller lever 32.

The comparison of the position of the end E5 of spring 56 in FIGS. 8, 9 and 10 shows the corresponding positions of intermediate element 5 as cam 11 passes through on the basic circle and at the maximum stroke of the cam.

Figure 11:
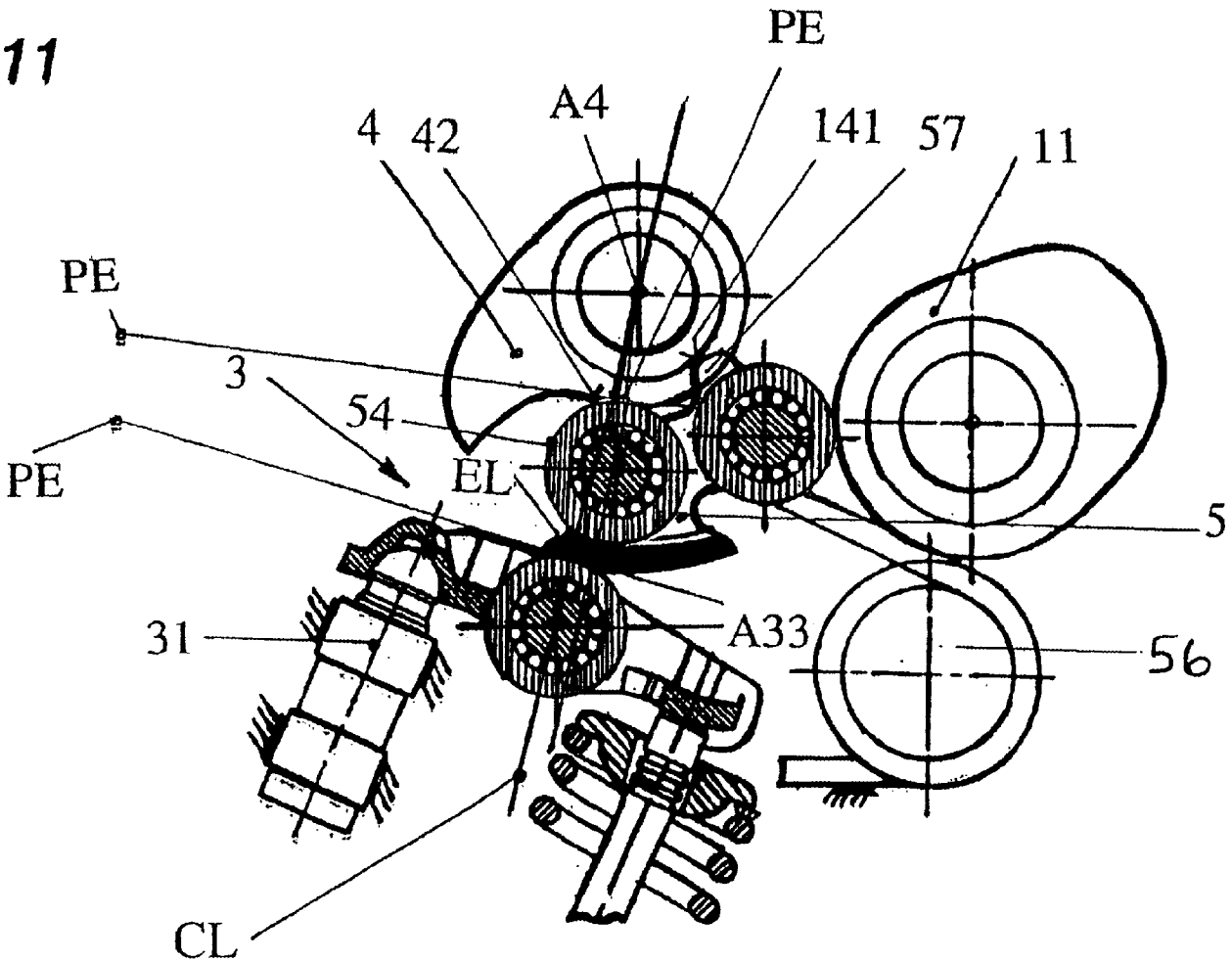
FIG. 11 shows a valve drive as defined by the invention with three rollers and sliding supports arranged on the intermediate element.

FIG. 11 shows a valve drive as defined by the invention with the valve in the closed position. Intermediate element 5 has an additional roller 54 that is engaged with control cam 42. The lines of engagement EL between intermediate element 5 and stroke-transmitting arrangement 3 is disposed on the line of connection CL between the axis of swivel A4 and the axis A33 of roller 33 on arrangement 3 transmitting the stroke. In the present case, however, the planes of engagement PE on intermediate element 5 between control cam 42 and stroke-transmitting arrangement 3 are inclined toward each other, and the line of engagement EL between the roller 54 and the control cam 42 is disposed in an area close to the line of connection CL.

In the present embodiment, support cam 141 is radially recessed and axially offset vis-à-vis control cam 42. Sliding supports 57 are arranged on intermediate element 5 on both sides of control cam 42 and the adjoining peripheral area. These supports 57 are engaged with the one or more of radially recessed support cams 141, and axially engaged with the adjoining peripheral area of control cam 42. An axial guidance of intermediate element 5 is achieved in this manner.

FIG. 12 shows a set of approximately symmetrical curves representing the stroke of the valve that can be adjusted with the system as defined by the invention for opening the valve in a variable manner.

Figure 13:
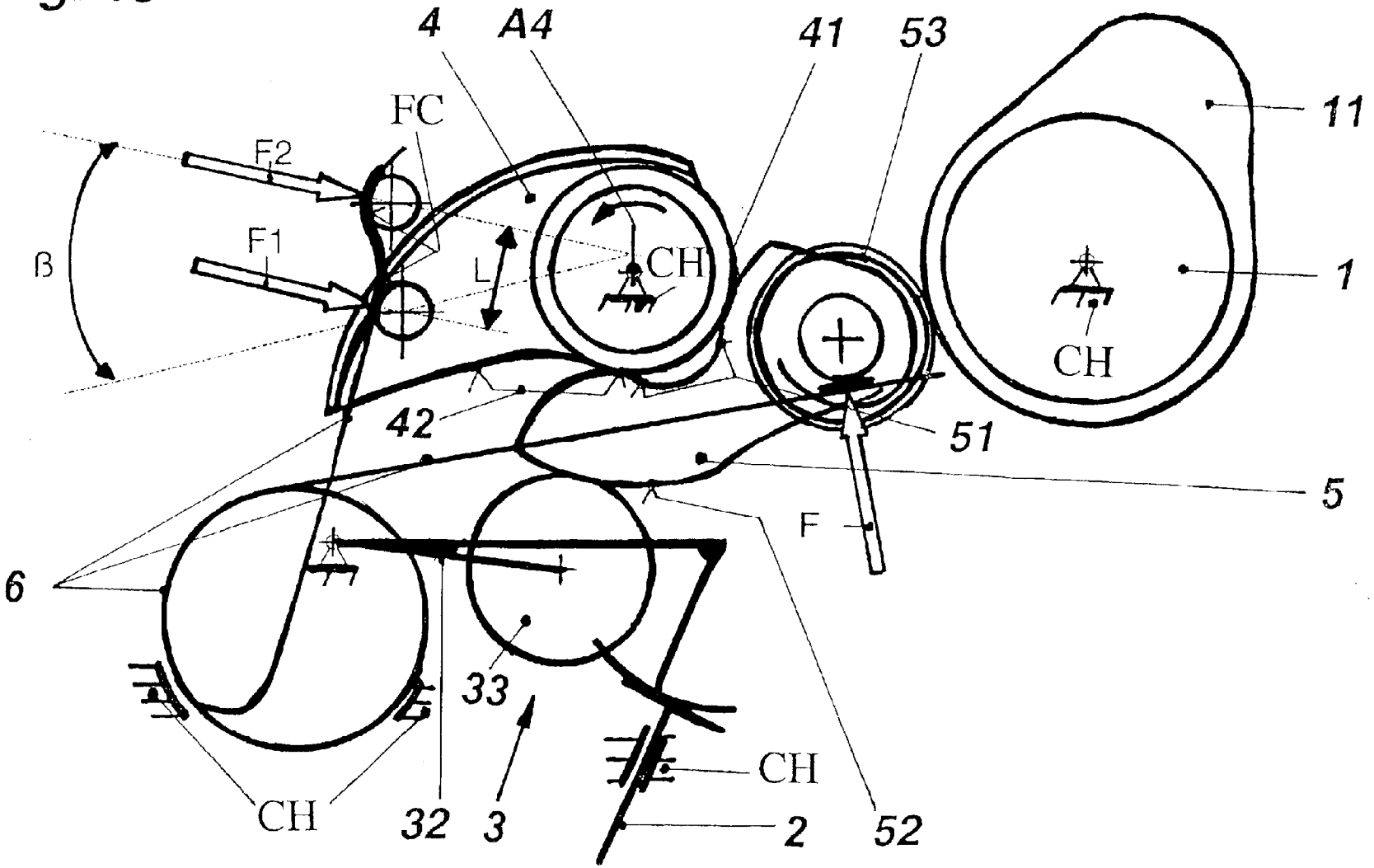
FIG. 13 shows a valve drive according to FIG. 7; however, with a differently designed spring arrangement shown by a schematized representation.

In FIG. 13, a spring 6 acting on intermediate element 5 is supported on variable element 4 in a special way. This spring is realized in the form of a wound flexible spring. The force F1 of spring 6 generates a moment of rotation or support (F1×L1) in the direction of an adjustment on variable element 4 for a greater stroke (see FIG. 13).

This arrangement permits spring force F acting on intermediate element 5 to be adjusted with greater dependence on the adjusted stroke. A torque (F1×L1) can be additionally introduced into variable element 4 with support cam 41 and control cam 42. Such a torque acts parallel with a moment directed at adjusting a greater stroke, with the effect that the retaining or setting moment required for variable element 4 is basically supported in the direction of a greater stroke. Spring 6 is preferably supported on variable element 4 by a variable line contact, whereby in the range of zero stroke, the force F2 of spring 6 extends through the axis of swivel A4 of variable element 4, or extends close to this axis. With such a design, the moment acting on variable element 4 due to the force of spring 6 by means of a small or missing lever arm L is low or zero (see the line of action F2). Under certain constructional conditions, a low moment may also act with the adjustment of zero-stroke (see line of action F2). Such a moment then has to be counteracted by a retaining or setting moment acting on variable element 4.

An increasingly larger lever arm L ensues for the force F of spring 6 as the size of the adjusted stroke is growing, so that the moment acting on variable element 4 in the direction of greater stroke is increased. Spring 6 may advantageously have an area that is in contact on the variable element 4 during swiveling in the range of swivel β. Such an area has a contour FC for influencing the setting of the spring force F in dependence on the position of variable element 4. Spring 6 is designed in the form of a wound flexible spring and is supported and guided with its cylindrical part on the cylinder head CH.

Accordingly, while only a few embodiments of the present invention have been shown and described, it is obvious that many changes and modifications may be made thereunto without departing from the spirit and scope of the invention.

What is claimed is:

1. A system for variably actuating valves in an internal combustion engine, comprising:

a camshaft rotationally supported in a cylinder head of said engine, said camshaft having a fixed position in relation to the valves;

a stroke-transmitting arrangement guided in a fixed position and associated with each of the valves arranged in the cylinder head, the valves closing by means of spring force, said camshaft having a fixed position in relation to said stroke-transmitting arrangement;

a variable position element for adjusting the stroke of the valve and being guided in a stationary manner in the cylinder head;

an intermediate element supported and pivotably guided on the variable position element; and a cam of the camshaft supported in a stationary manner in the cylinder head, said intermediate element engaging the cam and the stroke-transmitting arrangement;

wherein the variable position element is adapted to pivot around an axis of swivel positioned fixed in the cylinder head and comprises a support cam and a control cam arranged one after the other, and wherein the intermediate element is supported in a force-locked manner and slides around an outer contour of the support cam and control cam by a U-shaped inner contour opening.

2. The system according to claim 1, wherein the support cam and control cam extend over an area of more than 180°.

3. The system according to claim 1, wherein the outer contour of the support cam of the variable position element is formed by a circular arc around an axis of swivel.

4. The system according to claim 1, wherein the outer contour of the support cam is formed in an area engaging the cam of the camshaft by a circular arc around the axis of swivel, and the outer contour changes into an ascending contour in a range of the stroke.

5. The system according to claim 1, wherein the support cam is arranged on a half of the variable position element facing the cam of the camshaft.

6. The system according to claim 1, wherein on a side facing the stroke-transmitting arrangement, the control cam, in a position for zero or minor stroke, is arranged parallel with or slightly inclined toward said stroke-transmitting arrangement.

7. The system according to claim 1, wherein within a range of motion from high valve-actuating forces, lines of engagement between the control cam and the intermediate element extend around a straight line of connection between the axis of swivel of the variable position element and a line of engagement between the stroke-transmitting arrangement and the intermediate element.

8. The system according to claim 7, wherein the lines of engagement are disposed in an area extending closely around a line of connection between the axis of swivel and an axle of a roller on the stroke-transmitting arrangement.

9. The system according to claim 6, wherein the intermediate element engages the cam of the camshaft such that in a course of an opening stroke, the intermediate element is pulled through oppositely disposed areas of engagement on the control cam and the stroke-transmitting arrangement.

10. The system according to claim 1, wherein the stroke-transmitting arrangement has an element compensating for play.

11. The system according to claim 1, wherein the stroke-transmitting arrangement is supported in the cylinder head in an area below the camshaft.

12. The system according to claim 1, wherein a spring force retains the intermediate element in engagement with the cam of the camshaft and with the variable position element.

13. The system according to claim 12, wherein a component of the spring force comprises a wound flexible spring that engages the intermediate element.

14. The system according to claim 13, wherein the spring is supported in an area of a roller on the intermediate element in a sliding manner, and is supported on the cylinder head in a stationary manner.

15. The system according to claim 13, wherein the spring is arranged around the axis of swivel.

16. The system according to claim 13, wherein the spring is supported on the variable position element, and the spring force on the variable position element causes a rotary or support moment in a direction of adjustment toward a greater stroke.

17. The system according to claim 16, wherein the spring is supported on the variable position element by line contact; and wherein within a range of zero stroke, the force of the spring passes through or close to the axis of swivel of the variable position element.

18. The system according to claim 16, wherein the spring has an area engaging the variable position element, and wherein there is a contour in said area for influencing adjustment of the spring force in dependence on a position of the variable position element.

19. The system according to claim 16, wherein a cylindrical part of the spring is supported and guided on the cylinder head.

20. The system according to claim 1, wherein on the variable position element, the support cam is radially recessed and axially offset versus the control cam.

21. The system according to claim 20, wherein sliding supports are arranged on the intermediate element on both sides of the control cam and an adjoining peripheral area, said sliding supports engaging the radially recessed support cams and axially engaging the adjoining peripheral area of the control cam.

22. The system according to claim 1, wherein the variable position element is supported in the cylinder head with a circular segment, said circular segment being arranged on the control cam opposite an area of engagement of the intermediate element.

* * * * *